US005800201A

United States Patent [19]

Takata et al.

[11] Patent Number: 5,800,201

[45] Date of Patent: Sep. 1, 1998

[54] CONNECTOR ASSEMBLY FOR WIRE HARNESS AND METHOD FOR COUPLING THE SAME

[75] Inventors: Kensaku Takata; Junichi Ono, both of Nagoya, Japan

[73] Assignees: Sumitomo Wiring Systems, Ltd.; Harness System Technologies Research, Ltd.; Sumitomo Electric Industries, Ltd., all of, Japan

[21] Appl. No.: 760,950

[22] Filed: Dec. 9, 1996

[30] Foreign Application Priority Data

Dec. 11, 1995 [JP] Japan ..... 7-321771
Feb. 6, 1996 [JP] Japan ..... 8-019654

[51] Int. Cl.[6] ..... H01R 13/58

[52] U.S. Cl. ..... 439/466; 439/364

[58] Field of Search ..... 439/466, 468, 439/364, 34

[56] References Cited

U.S. PATENT DOCUMENTS 5,259,785 11/1993 Inaba et al. ..... 439/466
5,328,388 7/1994 Fust et al. ..... 439/364
5,486,119 1/1996 Nabeshima et al. ..... 439/364

FOREIGN PATENT DOCUMENTS 6427982 2/1989 Japan .
554933 3/1993 Japan .

*Primary Examiner*—Gary F. Paumen
*Attorney, Agent, or Firm*—Jordan B. Bierman; Bierman, Muserlian and Lucas

[57] ABSTRACT

A connector assembly for a wire harness includes first and second connectors. The connector assembly has a simple structure. The assembly effectively protects electric wires for a wire harness which is provided in a second unit and facilitates to interconnect the first and second connectors when the second unit is coupled to a first unit. In the connector assembly, a protector (WP) for a wire harness includes a protector body (18) which protects the wire harness and a connector holder (20) which supports the second connector (C2) connected to a distal end of the electric wires in the wire harness. The protector (WP) is provided in the second unit while the first connector (C1) to be coupled to the second connector (C2) is secured to the first unit. The securing position is set so that the connectors (C1, C2) are opposed to each other when the units are coupled to each other.

13 Claims, 8 Drawing Sheets

CONNECTOR ASSEMBLY FOR WIRE HARNESS AND METHOD FOR COUPLING THE SAME

BACKGROUND OF THE INVENTION

This invention relates to a connector assembly for a wire harness which is used to electrically interconnect electrical units and a method for coupling the same.

In general, a connector assembly is utilized for electrical connection of electrical units (for example, electrical connection between a dashboard for an automobile and an instrument panel). For example, a first connector for a first unit is coupled to a second connector for a second unit, thereby electrically interconnecting the units.

There are two typical methods for coupling the connectors to each other.

A) A first connector is fixed on a first unit beforehand while a second connector is fixed on a second unit predeterminedly. The fixing positions of the first and second connectors on the first and second units are set so that the housings of the connectors are coupled to each other upon coupling the units to each other.

B) A first connector is fixed on a first unit while a second connector is hung from a second unit through electric wires. After the units have been coupled to each other, the second connector is connected to the first connector.

However, the method A may be unable to couple the connectors to each other if there is a slight error in the attaching position of the connectors on the units. Even if the connectors are precisely attached to the units, respectively, it is very difficult to couple the first and second units to each other while coupling properly the housings of the connectors to each other. Consequently, the units may be forcedly coupled in spite of being improperly connected, resulting in breakage of the connector housings.

On the other hand, in the method B, since the second connector is hung from the second unit through the electric wires before the second unit is coupled to the first unit, the electric wires may be caught by obstacles in an assembly line, thereby causing excess tension in the wires. This results in problems such as wire breakage, falling of the terminals, and the like. Since the second connector is remote from the first connector after the units have been coupled to each other, it is necessary to carry out a work of connecting the second connector to the first connector after finding the second connector. Such work is troublesome.

Heretofore, a structure has been known in which one connector is fixed on a unit in a usual manner and the other connector is attached to the other unit movably in a direction perpendicular to a connector connecting direction (for example, Japanese Utility Model Public Disclosure No. SHO 64-27982 (1989)). For convenience of explanation, this structure will be described below by referring to FIGS. 11A and 11B. FIG. 11 is a longitudinal sectional view of a conventional connector assembly, illustrating a position (A) prior to coupling and a position (B) after coupling.

In FIGS. 11A and 11B, a first connector C1 having a female housing is completely secured to a first unit U1 while a second connector C2 having a male housing is attached to a second unit U2 movably in a direction perpendicular to a connector connecting direction (up and down direction in the drawing). In more detail, the male housing of the second connector C2 is provided on its proximal end with a flange 90 while the second unit U2 is provided with a stopper piece 92 for restraining the flange 90 from moving upward.

Springs 94 are inserted inside the stopper piece 92. The connector C2 is held at a given position in the second unit U2 by elastic forces of the springs 94.

According to this structure, even if the securing position of the first connector C1 on the first unit U1 or the securing position of the second connector C2 on the second unit U2 is misaligned more or less, this misalignment will be absorbed by displacement of the second connector against the elastic forces exerted in the springs 94.

In the above structure, if the units are slightly inclined with respect to each other during insertion of the male housing of the second connector C2 into the female housing of the first connector, the second connector C2 and stopper piece 92 are subject to a great bending moment, thereby breaking the flange 90 or the stopper piece 92 (see a circle K in FIG. 11B).

Japanese Patent Public Disclosure NO. HEI 5-54933 (1993) discloses a connector connecting structure in which connector housings are coupled to each other but terminals are not coupled to each other when units are interconnected in order to protect the terminals in the connectors and the terminals are finally interconnected by turning the connectors upon completing the connection of the units. Since the structure does not protect the connector housings although it protects the terminals, the connector housings may be broken upon coupling the units to each other.

Heretofore, connectors and wire harnesses are utilized to electrically interconnect electrical units. A process for coupling the connectors to each other includes the steps of: arranging a wire harness in a first unit; securing to the first unit a first connector connected to ends of electric wires in the wire harness; arranging a wire harness in a second unit; connecting a second connector to ends of electric wires in the wire harness with the second connector being hung from the second unit through the wires; coupling the units to each other; and connecting the second connector to the first connector.

The wire harnesses are accommodated in a protector having a configuration corresponding to an arranging configuration of the wire harnesses, if desired, thereby protecting the wire harnesses. Since the electric wires in the wire harnesses are exposed from the protector in an area from an end of the protector to the second connector, the wires are not protected effectively in the area. In addition, since the second connector is hung from the second unit through the wires before the second connector is coupled to the first connector, the hung wires are caught by any obstacles in an assembly line. In this case, the wires will be subject to excess tension, thereby causing problems such as wire breakage, falling of the terminals, and the like. Also, since the second connector is still hung from the second unit upon completing the connection of the units and remote from the first connector, the second connector cannot be connected to the first connector unless the second connector is manually found. This work is troublesome and inefficiency.

SUMMARY OF THE INVENTION

A first object of the present invention is to provide a connector assembly for a wire harness which has a simple structure, can protect connectors and electric wires in a wire harness to be connected to the connectors and can easily couple the connectors to each other.

A second object of the present invention is to provide a method for coupling the connector assembly for a wire harness, which protects connector housings in units upon coupling the units to each other and can easily and firmly interconnect the connectors after completing coupling of the units to each other.

In order to achieve the first object, a connector assembly for a wire harness in accordance with the present invention comprises: a first connector secured to a first unit; a second connector to be connected to the first connector, the second connector being provided on a second unit to be coupled to the first unit; and a protector for a wire harness being provided on the second unit and including a protector body which encloses and protects said wire harness and a connector holder which is formed together with the protector body and holds the second connector movably in a connecting direction to the first connector. The second connector is adapted to be connected to ends of electric wires in the wire harness. The wire harness to be connected to the second connector is arranged in the protector body. The second connector is temporarily held in the connector holder. A securing position of the first connector on the first unit is set so that the second connector is opposed to the first connector upon coupling the first and second units to each other.

According to the above structure, since the second connector is maintained spaced apart from the first connector immediately after the first and second units are coupled to each other, the second connector can be connected to the first connector by displacing the second connector as it is.

The following structure is preferable. A first screw member is secured to one of the first and second connectors. A second screw member having a rotary operation head is attached to the other connector rotatably and not movably in an axial direction. The screw members are positioned so that the one screw member on the first connector is opposed to the other screw member on the second connector when the first and second units are coupled to each other. The housings of the connectors are coupled to each other by screw engagement of the screw members while displacing the second connector with respect to the connector holder.

A connector-fastening tool may be prepared to fastening the housings of the connectors upon coupling the units to each other. The housing of the second connector is coupled to the housing of the first connector while displacing the second connector housing in relation to the connector holder by the fastening tool.

The following structure will be preferable. The first connector is fixed on the first unit. The second connector is provided on the second unit to be coupled to the first unit. One of the connectors has a female housing which is open to the other connector. The other connector has a male housing to be fitted in the female housing. The female housing is provided on the open end edge with a guide taper surface. The second unit is provided with a temporary latch means for detachably and temporarily supporting the second connector. A first screw member is fixed on one of the connectors. A second screw member is mounted on the other connector not slidably in an axial direction but rotatably in a peripheral direction. The second screw member is adapted to be engaged with the first screw member and has a rotary operation head. The fixing position of the first connector on the first unit and the temporary supporting position of the second connector on the second unit are set so that the housing and screw member of the second connector temporarily supported on the second unit are opposed to and spaced apart from the housing and screw member of the first connector fixed on the first unit when the first and second units are coupled to each other. The screw members are engaged with each other-so that the male housing enters the female housing when the second connector is released from being temporarily supported on the second unit.

According to the above structure, it is possible to avoid breakage of the housings upon coupling the units to each other, since the first connector and its screw member are opposed to and spaced apart from the second connector and its screw member immediately after the first and second units are coupled to each other. Then, the second connector is released from being temporarily supported on the second unit by pushing the rotary operation head of the screw member on the second connector. The connectors are interconnected while engaging the screw member of the second connector with the screw member of the first connector by turning the rotary operation head.

Preferably, one of the screw members is a bolt provided on the distal end with a tapered surface and the other screw member is a nut having a screw hole provided with a tapered surface on the open edge.

According to this structure, after coupling the units, the bolt is engaged with the nut, thereby fitting and securing the housings of the connectors. In addition, since the tapered surfaces are formed on the distal end of the bolt and on the open edge of the screw hole in the nut, it is possible to smoothly carry out the work of inserting the bolt into the screw hole.

It is preferable in this structure for a spaced distance between the connectors to be made large in order to surely prevent the connectors from coming into contact with each other upon coupling the units each other. However, if the spaced distance is too large, the second connector may shift from a position where it is capable of coupling to the first connector, thereby resulting in difficulty in mating. However, in the case where a guide portion is provided on the temporary supporting portion to guide the second connector from a temporary supporting position for the second connector to a position in which the tapered surface on the screw member on the second connector is trapped by the tapered surface on the screw member on the first connector, it is possible to guide the second connector from the former to the latter and to properly couple the connectors after the second connector is released from temporary supporting, even if a spaced distance between the connectors is set to be relatively large. Thus, the connector fitting will be carried out thereafter without any problems.

The portion in which the tapered surface on the screw member on the second connector is trapped by the tapered surface on the screw member on the first connector described above means that the tapered surface of the second connector is in a position capable of coming into contact with the tapered surface of the first connector and is restrained from moving by the contact.

The guide portion may be provided at a position in which it is still in contact with the second connector after the second connector is completely coupled to the first connector. A resilient guide portion made of rubber or the like will absorb vibration between the first and second connectors and requires no clearance between the guide portion and the second connector, thereby properly guiding the connector.

In order to achieve the second object, a method for coupling a connector assembly for a wire harness in which a first connector fixed on a first unit and a second connector provided on a second unit to be coupled to the first unit are interconnected, in accordance with the present invention comprises the steps of: securing a first screw member to one of the connectors; attaching a second screw member to the other connector not slidably in an axial direction but rotatably in a peripheral direction, the second screw member being adapted to be engaged with the first screw member and having a rotary operation head; setting the fixing position of the first connector on said first unit and the temporary supporting position of the second connector on the second unit so that the housing and screw member of the second connector temporarily supported on the second unit are opposed to and spaced apart from the housing and screw member of the first connector fixed on the first unit when the first and second units are coupled to each other; releasing the second connector from being temporarily supported on the second unit; and coupling the housings of the connectors to each other while engaging the screw members with each other.

The present invention includes any temporary supporting means such as latch protrusions, an adhesive tape, or the like for temporarily holding the second connector in the second unit. It is necessary, however, to provide on the second unit with a temporary supporting frame which is open to the first connector and receives the second connector through the opening, to secure a resilient holding material to the inside of the temporary supporting frame and to form on the resilient holding material an engaging part for temporarily latching the second connector, thereby readily carrying out the temporary supporting of the second connector upon engagement of the engaging part and second connector. In addition, a slight displacement of the second connector will be allowed by an elastic deformation of the resilient holding material under the temporary supporting position. Consequently, it is possible to more smoothly couple the housings of the first and second connectors.

DETAILED DESCRIPTION OF THE PREFERRED EMBODIMENTS

A first embodiment of a connector assembly for a wire harness in accordance with the present invention will be explained below by referring to FIGS. 1 to 6. In this embodiment, a dash-panel 10 of a car body corresponds to a first unit while an instrument-panel 12 corresponds to a second unit. However, it should be noted that a wiring arrangement of the present invention is not limited to the above corresponding relationship. For example, the instrument-panel 12 may be a first unit while the dash-panel 10 may be a second unit. Further, it will be understood by a person skilled in the art that a wire harness may be used in one of a pair of units to be interconnected and connectors in the units may be coupled to each other in place of the dash-panel 10 and instrument-panel 12.

Figure 1:
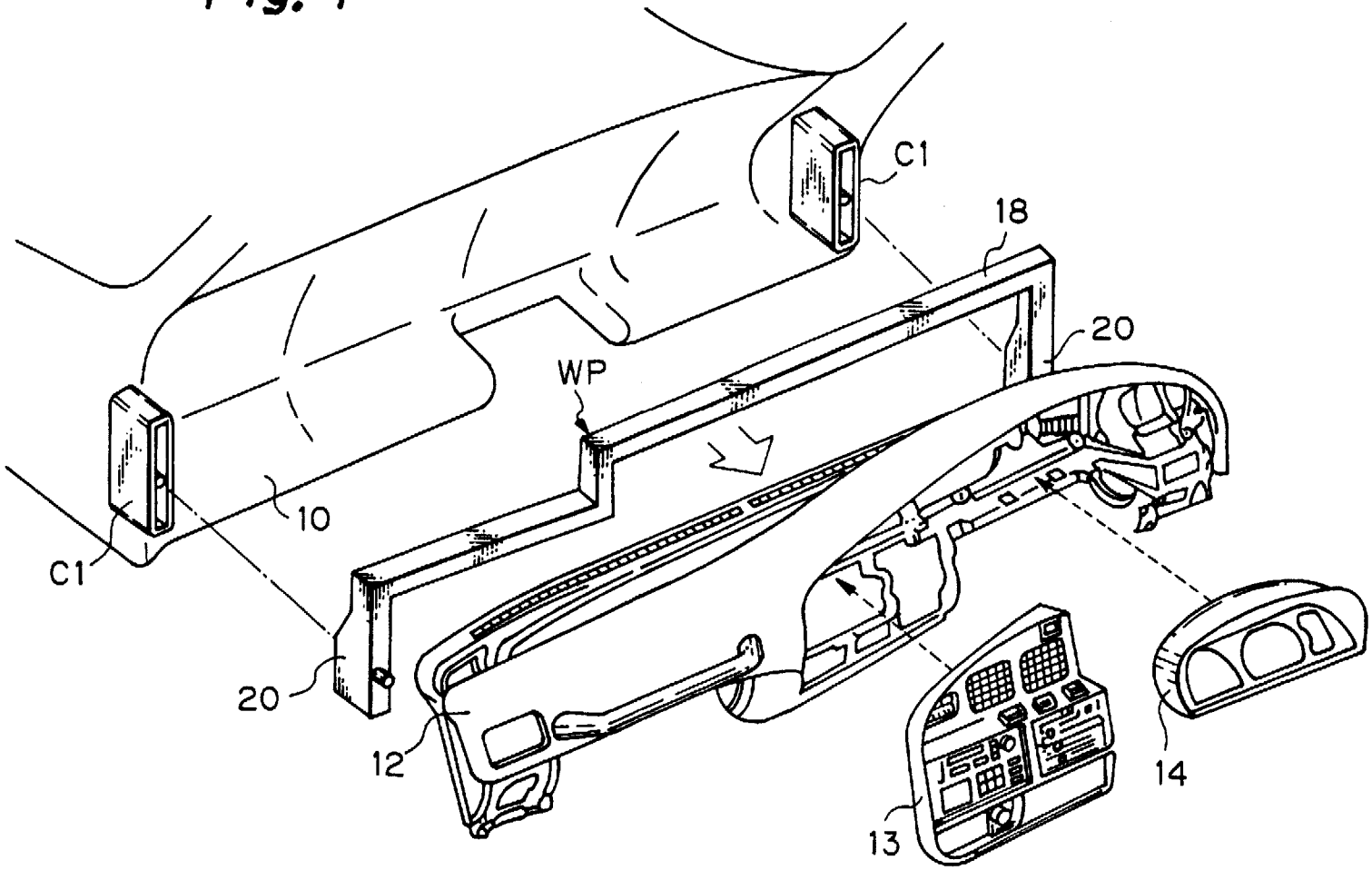
FIG. 1 is an exploded perspective view of a first embodiment of a connector assembly for a wire harness in accordance with the present invention, illustrating a dash-panel, an instrument-panel and a protector for a wire harness.
Figure 2:
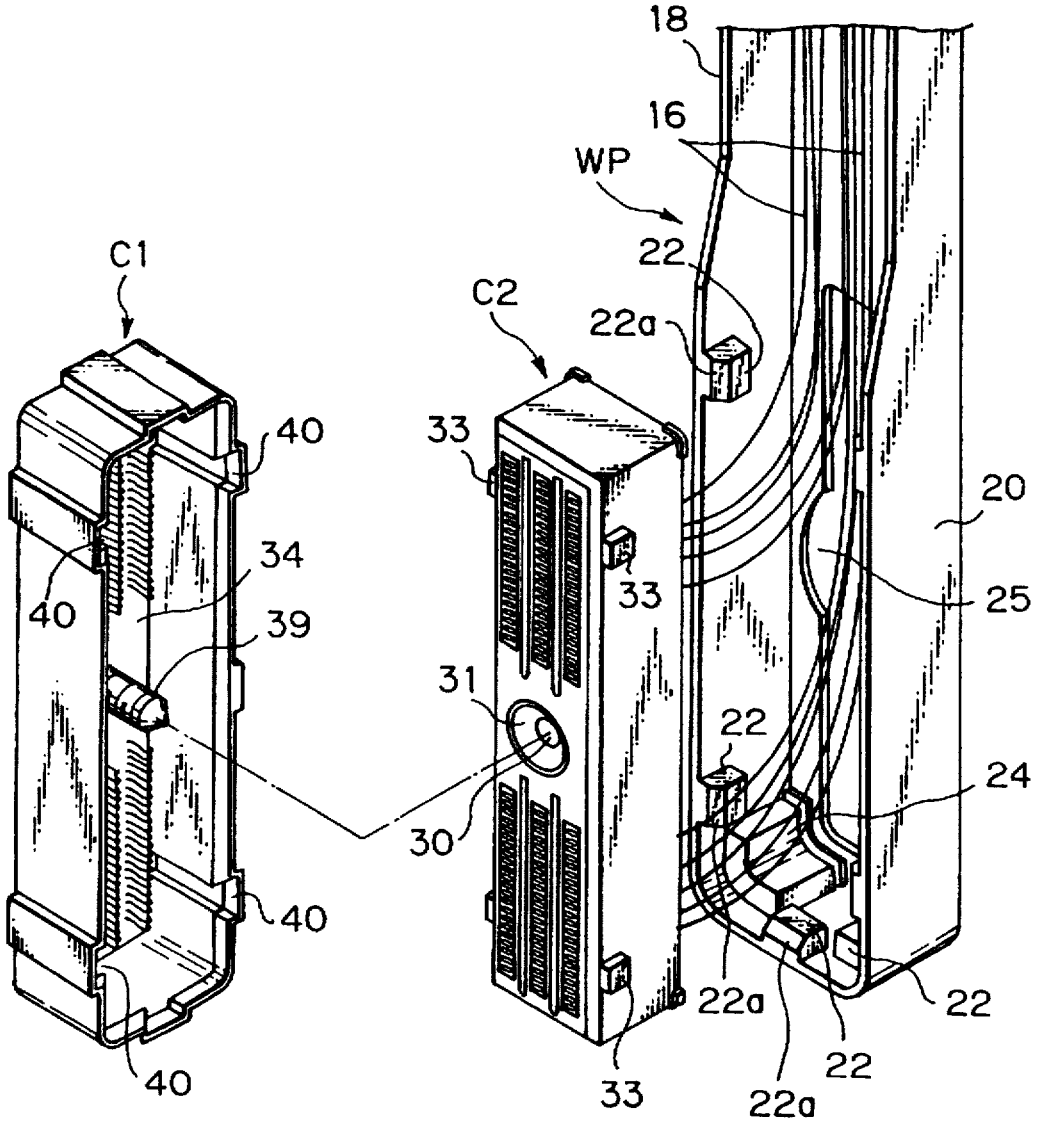
FIG. 2 is an exploded perspective view of the protector for a wire harness, illustrating a connector holder and a first connector and a second connector to be supported by the holder.

As shown in FIG. 1, the dash-panel 10 is provided with screw holes not shown while the instrument-panel 12 is provided on the positions associated with the screw holes with bolt through-holes not shown. The instrument-panel 12 is secured to the dash-panel 10 by screwing bolts not shown into the screw holes through the bolt through-holes.

Meters 13 and 14 are mounted on the front surface of the instrument-panel 12 while a protector WP for a wire harness in accordance with the present invention is mounted on the rear surface of the panel 12. The protector WP is made of a synthetic resin material and includes a protector body 18 having the same configuration as the arrangement of wire harnesses (which extend from the left to the right in the drawing) and a connector holder 20 formed together with the body 18 on opposite ends of the protector body 18. The wire harnesses are arranged in the protector holder 20 along its length, thereby protecting the wire harnesses and temporarily holding a second connector C2 to be connected to ends of electric wires 16 in the wire harnesses (FIGS. 2 to 6) in the connector holder 20.

On the other hand, wire harnesses (not shown) are also arranged on the side surface of the dash-panel 10. The first connector C1 is connected to ends of the electric wires in the wire harnesses (The first connector C1 is provided on the right and left ends of the dash-panel 10 in FIG. 1). The first connector C1 is fixed in opposition to the second connector C2 on the dash-panel 10. When the first connectors C1 are coupled to the second connectors C2, the wire harnesses in the dash-panel 10 are electrically connected to the wire harnesses in the instrument-panel 12.

The connector holder 20 is provided on an inner side with a rectangular opening. A plurality of guide projections 22 are provided on the end edge of the opening to extend inwardly. Each guide projection 22 is provided with a tapered surface 22*a* which is opposed to the dash-panel 10. The connector holder 20 is provided on its inner parts with hollow resilient holding members 24 made of an elastic material such as rubber or the like. Each member 24 is provided in its inner part with a latch recess 24*a*. The connector holder 20 is provided on its rear wall (the right side wall in FIGS. 2 to 6) with a through-hole 25 while the instrument panel 12 is also provided with a through-hole (not shown) which is communicated with the through-hole 25.

In this embodiment, the second connector C2 has a male housing, which rotatably supports a cylindrical nut 26 on a center portion. The nut 26 is restrained from axially moving by means of a clip ring 28.

The nut 26 may not be completely restrained from moving axially relative to the second connector C2. The nut 26 may be slightly displaced axially relative to the second connector C2 when the connector housings of the connectors C1 and C2 are interconnected in association with a screw engagement of the nut 26 and a bolt 39 described hereinafter.

The nut 26 is provided in its center portion with a screw hole 30 opposed to the first connector C1. The screw hole 30 is provided on its open end inner edge with a tapered surface 31 which gradually widens in diameter in a outward direction (in a leftward direction in FIGS. 3 to 6). The nut 26 is provided on its rear end with a flange 32 and a rotary operation head 29 which has a polygonal cross section adapted to be operated by a tool T such as an impact wrench or the like.

The housing of the second connector C2 is provided on its rear end (right end in FIGS. 3 to 6) with engaging protrusions 23. When the engaging protrusions 23 fit in the latch recesses 24*a* in the resilient holding members 24, the second connector C2 is temporarily held in the connector holder 20. The housing of the second connector C2 is provided on its side surfaces of a front end with guide protrusions 33. When the front ends of the protrusions engage with the rear ends of the guide projections 22, the second connector C2 is led in a straight direction to the first connector C1.

On the other hand, the first connector C1 is completely secured to the dash-panel 10 by bolts or the like, with the instrument-panel 12 being attached to the dash-panel 10, so that the first connector C1 is opposed to and spaced apart from the second connector C2 by a given distance d1.

The first connector C1 has a female housing provided on its center portion with a cavity 34. When the male housing of the second connector C2 enters the cavity 34 in the female housing of the first connector C1, connector terminals (not shown) in the first and second connectors C1 and C2 are interconnected.

The cavity 34 is provided on its open end with a tapered surface 38 opposed to the second connector C2 (rightward in FIGS. 3 to 6). A bolt 39 is fixed in the female housing of the first connector C1 so that the bolt 39 is opposed to the screw hole 30 in the nut 26 supported in the male housing of the second connector C2. The bolt 39 is adapted to be screwed into the screw hole 30 and is provided on its distal end with a tapered surface 39*a*.

Figure 4:
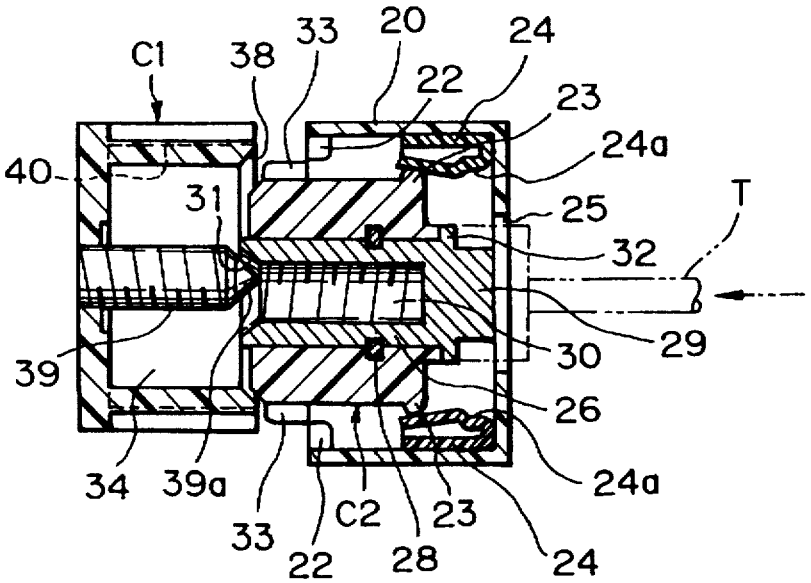
FIG. 4 is a longitudinal sectional view of the first and second connectors, illustrating a position in which a distal end of a bolt in the first connector comes into contact with an inlet of a nut in the second connector.

The distance d1 mentioned above is set so that the tapered surface 39*a* of the bolt 39 comes into contact with the tapered surface 31 of the nut 26 when the projections 22 have finished guiding the second connector C2, as shown in FIG. 4.

The female housing of the first connector C1 is provided in its cavity 34 with a guide groove 40 which serves to lead the guide protrusion 33 in the coupling direction upon inserting the male housing of the second connector C2 into the cavity 34.

Next, a wiring process in the above structure will be explained below.

First, the wire harnesses for the instrument-panel 12 are arranged in the protector body 18 of the protector WP for a wire harness and the second connectors C2 connected to opposite ends of the electric wires 16 in the wire harnesses are temporarily held in the connector holders 20. At this time, the engaging protrusions 23 on the second connector C2 enter the latch recesses 24*a* in the resilient holding member 24. Then, while maintaining this position, the protector WP for a wire harness is fixed at given positions on the rear side of the instrument-panel 12 by bolts or the like. Thus, the arranging step of the wire harnesses on the instrument-panel 12 are carried out simultaneously with the temporary holding step of the second connector C2.

On the other hand, wire harnesses are arranged on the side surface of the dash-panel 10. The first connectors C1 connected to the ends of the electric wires in the wire harnesses are fixed on the right and left ends of the dash-panel 10 to oppose to the second connectors C2.

Figure 3:
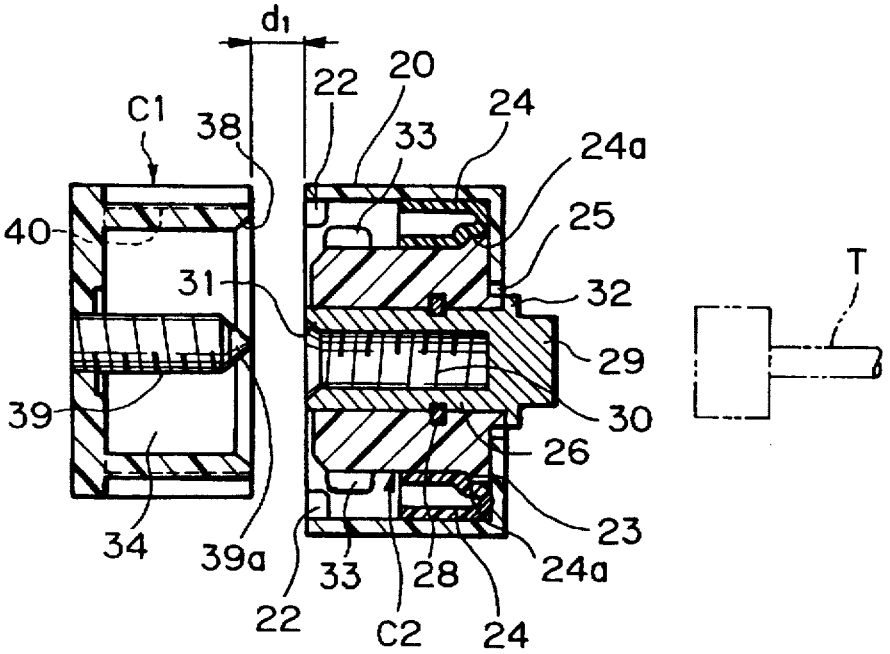
FIG. 3 is a longitudinal sectional view of the first and second connectors, illustrating a positional relationship between them immediately after attaching the instrument-panel to the dash-panel.

Next, the instrument-panel 12 is secured to the dash-panel 10 by superimposing the bolt through-holes (not shown) in the panel 12 on the screw holes (not shown) in the panel 10 and screwing the bolts (not shown) into the screw holes. Under this condition, the housings of the first and second connectors are not brought into contact with each other while maintaining the distance d1 therebetween, as shown in FIG. 3, although the housing of the second connector C2 which is temporarily held in the connector holder 20 is opposed to the housing of the first connector C1. Accordingly, it is possible to avoid breakage resulting from contact of the connectors.

As shown in FIG. 4, the tool T pushes the rotary operation head 29 to release engagement between the protrusions 23 and the latch recesses 24*a* (that is, to release the temporary holding) and to extrude the second connector C2 from the panel 20 to the first connector C1.

Since the guide protrusions 33 come into contact with the guide projections 22 so as to guide the second connector C2 in a direction to the first connector C1 immediately before the tapered surface 31 of the nut 26 comes into contact with the tapered surface 39*a* of the bolt 39, the second connector C2 does not shift greatly rightward or leftward upon releasing the temporary holding, thereby preventing the bolt 39 from going wide of the screw hole 30. In other words, the second connector C2 is securely led to the first connector C1 by means of the guide projections 22 before the distal end of the bolt 39 enters the screw hole 30 in the nut 26.

Figure 5:
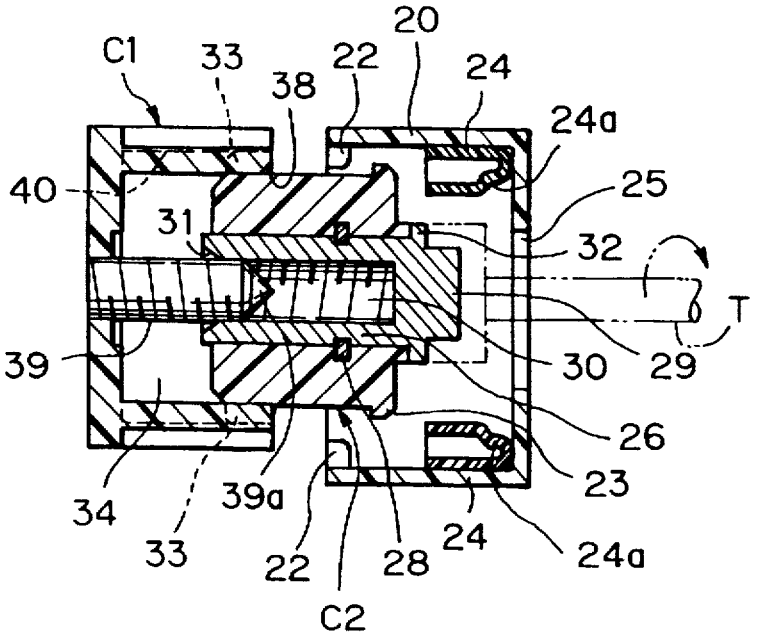
FIG. 5 is a longitudinal sectional view of the first and second connectors, illustrating a position in which the bolt is engaged with the nut.
Figure 6:
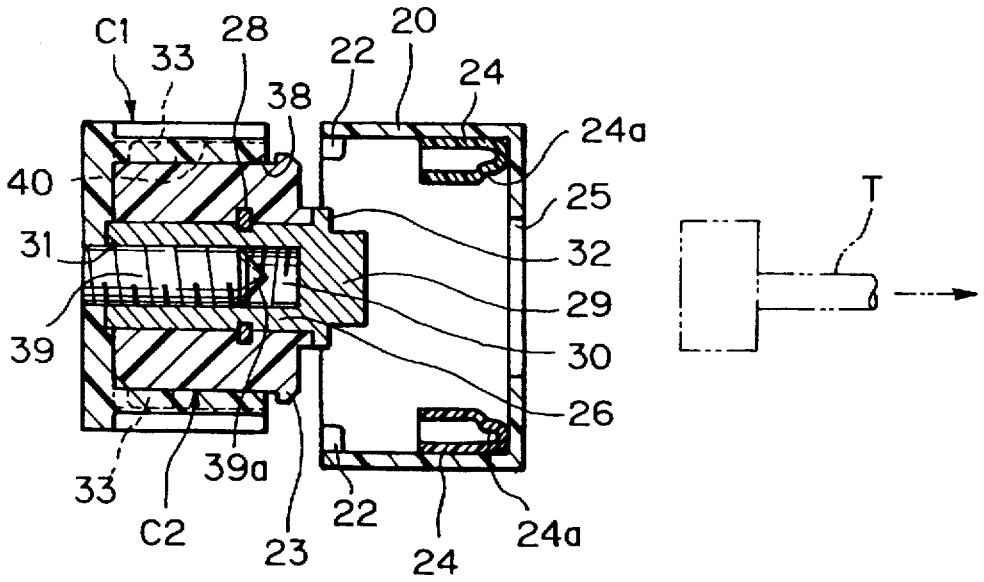
FIG. 6 is a longitudinal sectional view of the first and second connectors, illustrating a position in which interconnection of connector housings of the connectors has been completed.

The bolt 39 moves forward in the nut 26 from the position shown in FIG. 4 to the position shown in FIG. 5 by turning the nut by means of the tool T. Then, the male housing of the second connector C2 gradually enters the cavity 34 in the female housing of the first connector C1. Finally, the connectors C1 and C2 are completely coupled to each other, as shown in FIG. 6. Thereafter, the tool T is detached from the nut 26.

According to the above structure, it is possible to obtain the following effects:

(1) It is possible to avoid breakage of the second connector C2 and the electric wires 16 coupled to the connector C2 since the second connector C2 is temporarily supported in the connector holder 20 in comparison with the conventional connector assembly in which the second connector C2 hangs through the electric wires 16 in the wire harnesses from the instrument-panel 12.

(2) It is possible to directly couple the second connector C2 to the first connector C1 after the instrument-panel 12 is attached to the dash-panel 10, since the second connector C2 supported temporarily in the connector holder 20 is opposed to the first connector C1 when the instrument-panel 12 is attached to the dash-panel 10.

(3) Since the connector holders 20 are formed together with the protector body 18, the number of parts does not increase, the structure is simple and protection for a wire harness and temporary support of the second connector C2 can be effected at the same time. In addition, since the connector holders 20 continue to the protector body 18, the body 18 can firmly protect the electric wires 16 near the second connector C2, in comparison with the case of separating the second connector C2 from the body 18.

(4) If the wire harnesses are arranged in the protector body 18 and the second connector C2 connected to the wire harnesses are inserted in the connector holder beforehand, it is possible to carry out the arrangement of the wire harnesses in the instrument-panel 12 and the attachment of the second connector C2 at the same time merely by attaching the protector WP for a wire harness to the instrument-panel 12, thereby enhancing the efficiency of assembly work.

A second embodiment of a connector assembly for a wire harness in accordance with the present invention will be explained below by referring to FIGS. 7A and 7B.

A connector holder 20 is provided inside with a rectangular opening. A tapered surface 52 is formed on an inlet of the opening to be opposed to the dash-panel 10 (leftward in FIGS. 7A and 7B). A pair of temporary latch protrusions 54 are provided on an inner part of the opening.

A second connector C2 has a male housing provided on the front end with a plurality of terminal-connecting portions 56 (four portions in the illustrated example). Each terminal not shown is fixed on each portion 56. The male housing is provided on its right and left wings with a bolt through-hole 58 and on its upper and lower portions with a deflectable piece 60, on a rear end of which a latch protrusion 62 is provided. The second connector C2 is inserted from the side of the latch protrusion 62 into the connector holder 20. When the latch protrusion 62 slides over the latch protrusion 54, the second connector C2 is temporarily held in the connector holder 20.

The connector holder 20 is provided in an area including all of the terminal-connecting portions 56 and bolt through-holes 58 with a through-hole 25 for wiring. The instrument-panel 12 is provided with its own through-hole which accords with the through-hole 25.

On the other hand, a first connector C1 is completely secured to the dash-panel 10 by bolts or the like, with the instrument-panel 12 being attached to the dash-panel 10, so that the first connector C1 is opposed to the second connector C2. The first connector C1 has a female housing provided on its center portion with a cavity 34 which is adapted to receive the male housing of the second connector C2. The cavity 34 is provided in its bottom with terminal-connecting recesses 66 in opposition to the terminal-connecting portions 56. Terminals not shown are fixed on the bottom of the recesses 66. When the terminal-connecting portions 56 enter the terminal-connecting recesses 66, the first and second connectors C1 and C2 are interconnected.

Figure 7A:
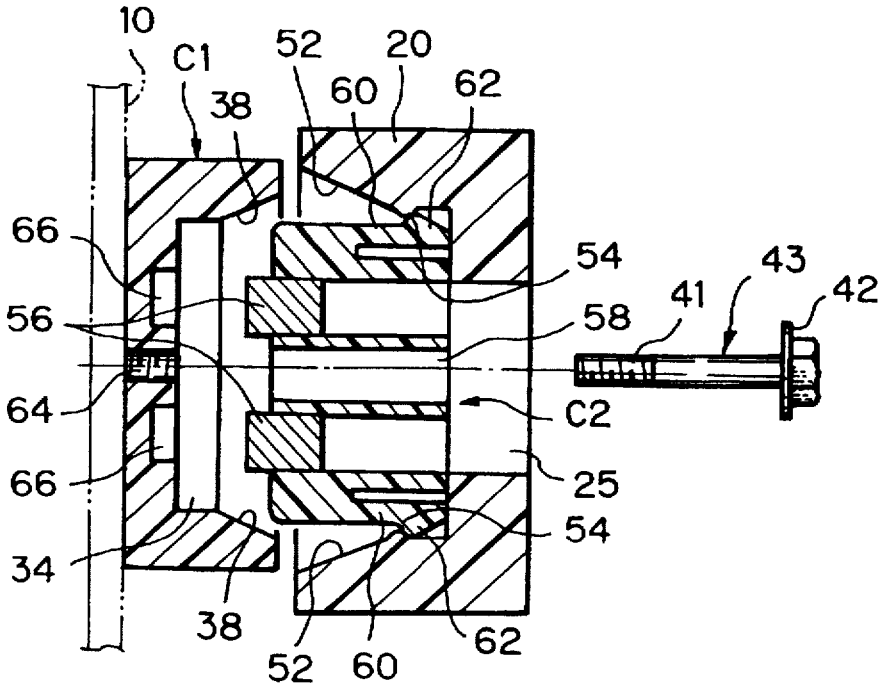
FIGS. 7A and 7B are a longitudinal sectional views of a second embodiment of a connector assembly for a wire harness in accordance with the present invention, illustrating an interconnecting structure of connectors.
Figure 7B:
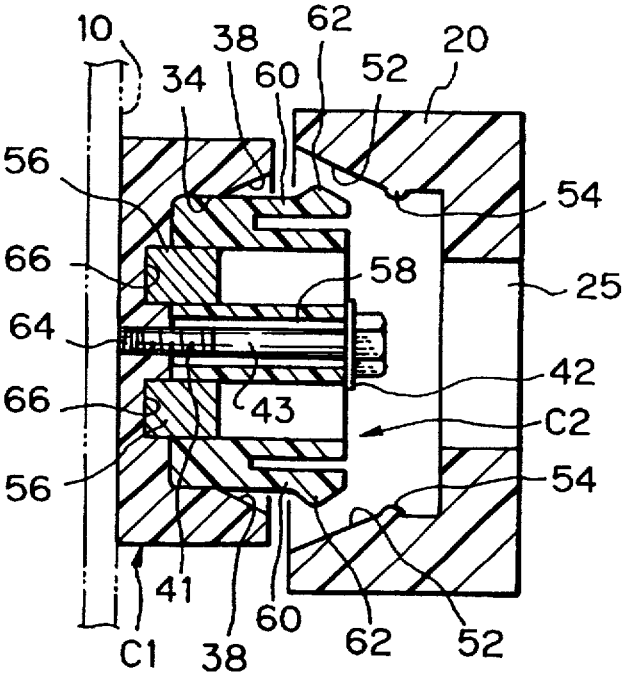

The cavity 34 is provided on its open end with a tapered surface 38 opposed to the second connector C2 (rightward in FIGS. 7A and 7B). The female housing of the first connector C1 is provided in opposition to each bolt through-hole 58 in the second connector C2 with a screw hole 64 having a smaller diameter than that of the hole 58. Attaching positions of the connectors C1 and C2 are set with respect to the dash-panel 10 and instrument-panel 12 so that the connectors C1 and C2 are spaced apart from each other by a slight distance, as shown in FIG. 7A, and the screw holes 64 are completely included in the bolt through-holes 58 when seen from the through-hole 25, under the attachment of the instrument-panel 12 on the dash-panel 10.

Further, this structure is provided with a connector-fastening tool such as a fastening bolt 43 for fastening the connectors C1 and C2. The fastening bolt 43 is provided on its one end with a male thread 41 and on its other end with a head having a flange 42. The male thread 41 is adapted to be screwed in the screw hole 64 in the first connector C1. The diameter of the flange 42 is larger than that of the bolt through-hole 58 in the second connector C2 but smaller than that of the through-hole 25.

According to the above structure, the connectors C1 and C2 are interconnected in the same manner as the first embodiment after the instrument-panel 12 is coupled to the dash-panel 10.

In the position immediately after coupling, the male housing of the second connector C2 is spaced apart from the female housing of the first connector C1 and does not come into contact with it. Accordingly, it is possible to avoid breakage of the connectors C1 and C2 which can result from their engagement.

At this time, the male thread 41 on the fastening bolt 43 is assured to enter the screw hole 64 through the bolt through-hole 58, even if the center axes of the connectors C1 and C2 are slightly shifted from each other due to any attaching error, as shown by the one-dot chain lines in FIG. 7A, since the bolt through-hole 58 in the second connector C2 is fairly greater than the screw hole 64. Then, the fastening bolt 43 commences to fasten the connectors C1 and C2 after engagement.

In fact, the fastening bolt 43 will commence the fastening when the flange 42 of the bolt 43 comes into contact with a peripheral edge around the bolt through-hole 58 in the second connector C2. The second connector C2 is drawn into the first connector C1 by the fastening force of the bolt 43 and the second connector C2 is detached from the connector holder 20 when the latch protrusions 62 on the second connector C2 slide over the temporary latch protrusion 54. The male housing of the second connector C2 is led into the cavity 34 in the female housing of the first connector C1 while being guided by the tapered surface 38. Finally, the terminal-connecting portion 56 is fitted in the terminal-connecting recess 66 and thus the interconnection of the connectors C1 and C2 is completed (FIG. 7B).

Accordingly, it is possible in the above structure to firmly protect the connectors C1 and C2 upon the interconnection of the dash-panel 10 and instrument-panel 12 and also to surely interconnect the connectors C1 and C2 by merely engaging the fastening bolt 43 with the screw hole 64 after finishing to couple the panel 12 to the panel 10.

Figure 8A:
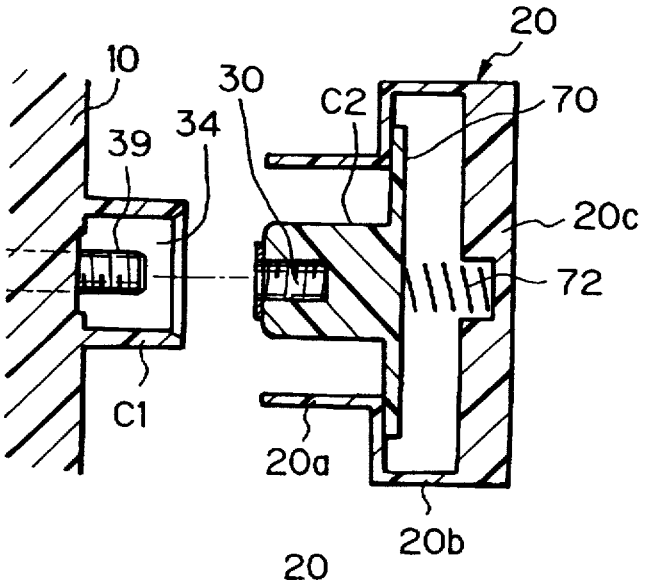
FIGS. 8A, 8B and 8C are longitudinal sectional views of a third embodiment of a connector assembly for a wire harness in accordance with the present invention, illustrating an interconnecting structure of the connectors.
Figure 8B:
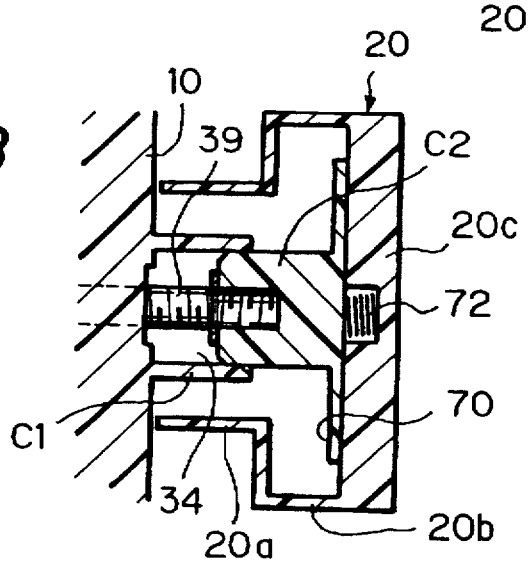
Figure 8C:
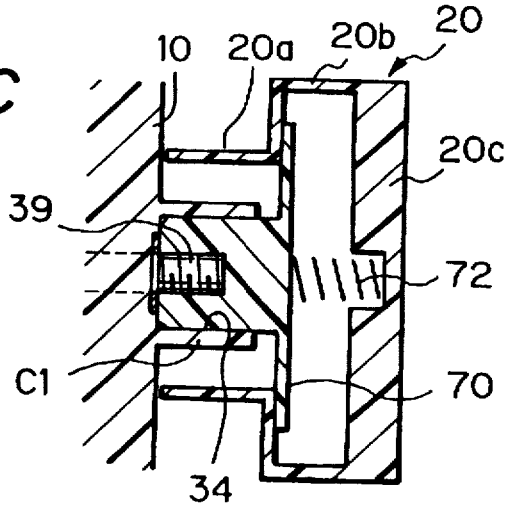

A third embodiment of the connector assembly in accordance with the present invention will be explained by referring to FIGS. 8A, 8B and 8C. A connector holder 20 includes a small diameter cylinder **20*a*, a large diameter cylinder 20*b* and a rear wall 20*c*. A second connector C2 has a male housing, which is provided in its center front end (left side end in FIG. 8) with a screw hole 30 and in its rear end (right side end in FIG. 8) with a stopper plate 70 which has an outer diameter greater than an inner diameter of the small diameter cylinder 20*a* but smaller than an inner diameter of the large diameter cylinder 20*b*. The stopper plate 70 is contained in the large diameter cylinder 20*b*. An elastic force exerted in a compression coil spring 72 disposed between the stopper plate 70 and the rear wall 20*c* holds the second connector C2 on a stepped portion between the small diameter 20*a* and the large diameter cylinder 20*b***.

On the other hand, the first connectors C1 are formed together with the dash-panel 10 and each connector C1 has a female housing provided with a cavity 34. A bolt 39 is supported in the dash-panel 10 so that the bolt 39 cannot move axially but rotate in the center in the cavity 34. When the instrument-panel 12 supporting the connector holder 20 is attached to the dash-panel 10, the male housing of the second connector C2 is inserted in the cavity 34 in the female housing of the first connector C1, as shown in FIG. 8B, and the distal end of the bolt 39 comes into contact with the inlet of the screw hole 30 so that the bolt 39 pushes the second connector C2 against the elastic force exerted in the spring 72. Then, the bolt 39 is turned to engage with the screw hole 30, whereby the second connector C2 is drawn into the cavity 34 in the female housing of the first connector C1 to interconnect the connectors C1 and C2, as shown in FIG. 8C.

Accordingly, any means for coupling the connectors C1 and C2 to each other can be applied to the connector assembly of the present invention after the first unit has been coupled to the second unit. For instance, after interconnecting the units, the male housing of the second connector C2 is manually pushed toward the connector holder 20 or detached therefrom and the male housing may be fitted in the female housing of the first connector C1 as it is. The connector holder may have any structure so long as it can hold the second connector C2 snugly.

Figure 9:
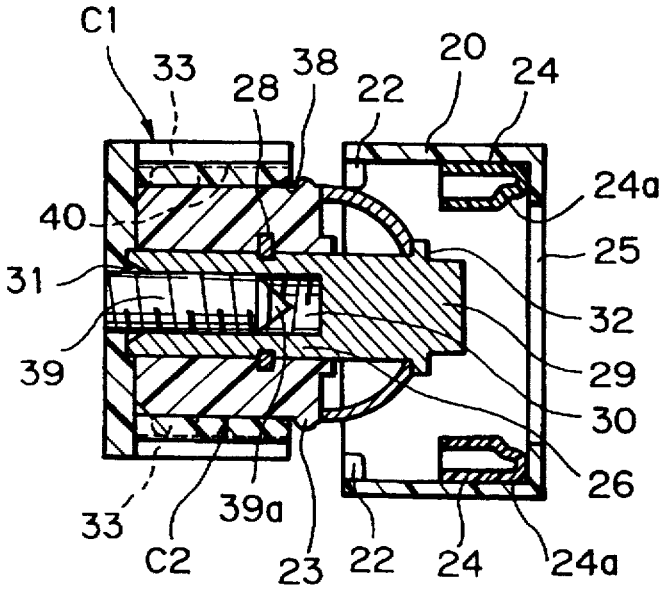
FIG. 9 is a longitudinal sectional view of a fourth embodiment of a connector assembly for a wire harness in accordance with the present invention, illustrating an interconnecting structure of the connectors.

A fourth embodiment of the connector assembly in accordance with the present invention is shown in FIG. 9. In this embodiment, a connector holder 20 may be provided in its inner surface with a guide projection 22 so that the guide projection 22 may come into contact with a part of the surface of a second connector C2 after the connectors C1 and C2 have been completely coupled to each other. In this case, if the guide projection 22 is made of a resilient material such as rubber, it can absorb a vibration between the connectors C1 and C2 and need no clearance therebetween, thereby effecting positive guidance.

Figure 10:
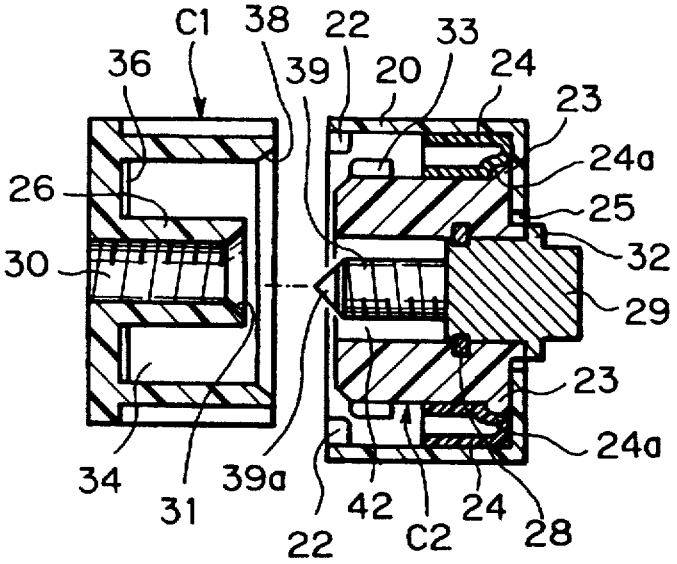
FIG. 10 is a fifth embodiment of a connector assembly for a wire harness in accordance with the present invention, illustrating an interconnecting structure of the connectors.
Figure 11A:
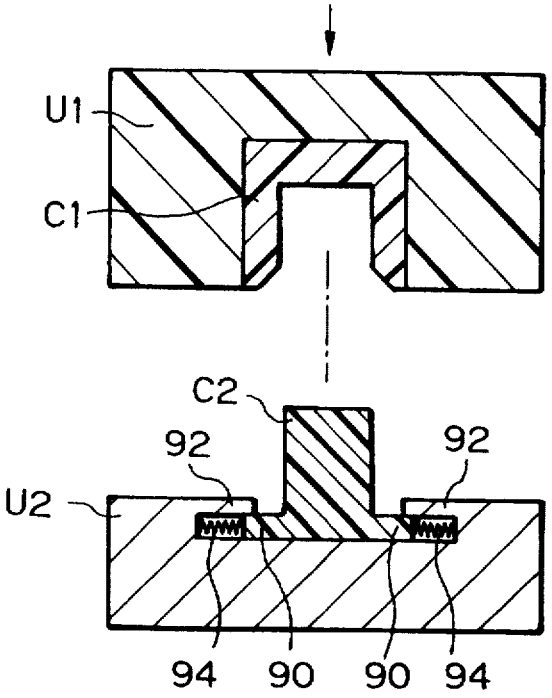
Fig. 11A PRIOR ART
FIGS. 11A and 11B are longitudinal sectional views of a conventional connector assembly, FIG. 11A illustrating a position in which the connectors are prior to coupling and FIG. 11B illustrating a position in which a bending moment is applied to a second connector during coupling.
Figure 11B:
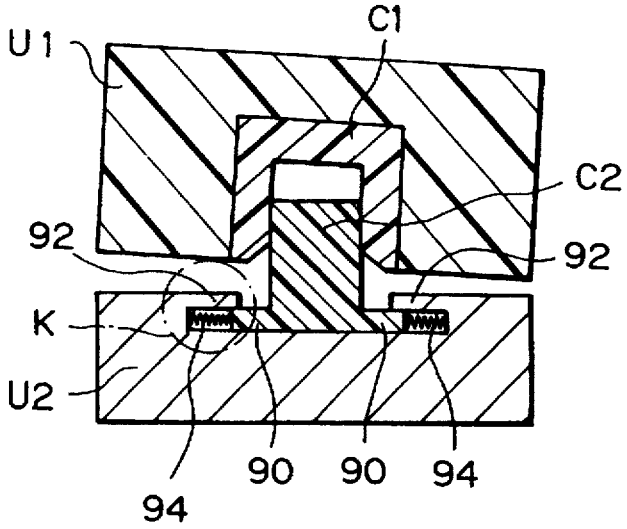
Fig. 11B PRIOR ART

A fifth embodiment of the connector assembly in accordance with the present invention will be explained below by referring to FIG. 10.

A first connector C1 is provided in its interior with a cylindrical nut 26 having a screw through-hole 30 in the center thereof. A bolt 39 is rotatably mounted on the center of an interior in a second connector C2. The bolt 39 has a flange 32 and a rotary operation head 29 on the rear end thereof. It is-possible in this embodiment to firmly couple the connectors C1 and C2 by means of a screw engagement between the bolt 39 and the nut 26. Tapered surfaces 39*a* and 31 of the bolt 39 and nut 26 enhance smooth screw engagement.

The present invention may include the following alterations:

(1) The first connector C1 may have a male housing while the second connector C2 may have a female housing although the first connector C1 has the female housing while the second connector C2 has the male housing in the above embodiments.

(2) The protector WP for a wire harness may be formed together with the instrument-panel 12 for the second unit although the protector WP is separated from the panel 12 in the above embodiments. It is possible in this alteration to temporarily hold the second connector C2 in the second unit without increasing the number of parts and to surely protect the second connector C2 and the electric wires 16 connected to the connector C2. In this case, however, the protector body 18 and connector holder 20 are separated from the second unit such as the instrument-panel 12 or the like and the protector WP for a wire harness is attached to the instrument-panel 12 after the wire harness and second connector C2 are set in the protector body 18 and connector holder 20 beforehand. This will greatly enhance an assembling work in comparison with an assembling work in which the wire harness is directly arranged on the instrument-panel 12 and then the second connector C2 is set in the connector holder.

(3) The protector for a wire harness in the present invention may not protect a whole wire harness by the protector body but protect a part (at least an area near the second connector C2) of the harness.

(4) The present invention includes any means for temporarily supporting the second connector C2 although the temporary supporting member 20 is formed together with the instrument-panel 12 in the above embodiments. For instance, the second connector C2 may be temporarily supported on the second unit by means of a double adhesive tape. In this case, an adhesive force exerted by the tape may be set to be such that can be broken when the rotary operation head 29 is pressed.

Since the protector for a wire harness in the present invention includes the protractor body which encloses the wire harnesses to protect them and a connector holder formed together with the protector body for holding a connector connected to the ends of the electric wires in the wire harnesses movably in a direction connecting to a mating connector, it is possible to protect the wire harnesses and connector connected to the electric wires in the wire harnesses together and to hold the connector in a given unit at the same time by means of a few parts.

In a wiring arrangement wherein a first connector is fixed on a first unit and a second connector to be coupled to the first connector is provided in a second unit to be coupled to the first unit, according to a wiring arrangement in which a protector for a wire harness is provided on the second unit, wire harnesses connected to the second connector are arranged in a protector body of the protector for a wire harness, the second connector is held in a connector holder, and a fixing position of the first connector on the first unit is set so that the second connector is opposed to the first connector upon coupling the first and second units to each other, it is possible to readily connect the second connector supported in the connector holder in the protector for a wire harness to the first connector after coupling the first and second units to each other.

Further, if the protector for a wire harness is separated from the second unit and the second unit receives the connector holder which supports the second connector and the protector body in which the wire harnesses are arranged, it is possible to make great strides in wiring and assembling works in comparison with a work of arranging the wire harnesses in the second unit directly and connecting the second connector to the wire harnesses.

It is possible according to the following structure to interconnect the first and second connectors by engaging the screw members with each other and fastening the connectors by using a fastening tool. A first screw member is secured to one of the first and second connectors. A second screw member having a rotary operation head is attached to the other connector rotatably and not movably in an axial direction. The screw members are positioned so that the one screw member on the first connector is opposed to the other screw member on the second connector when the first and second units are coupled to each other. The housings of each connector are coupled together by screw engagement of the screw members while displacing the second connector with respect to the connector holder. A connector-fastening tool is prepared to fastening the housings of the connectors upon coupling the units to each other. The housing of the second connector is coupled to the housing of the first connector while displacing the second connector housing in relation to the connector holder by the fastening tool.

In the present invention, the first connector is fixed on the first unit, the second connector is temporarily supported in the second unit to be coupled to the first unit, each connector is provided with the screw member adapted to engage with the mating screw member, the temporary supporting position of the second connector on the second unit is set so that the connectors and screw members are spaced apart from each other when the units are coupled to each other, and the male housing is fitted into the female housing in association with screw engagement of the screw members. Accordingly, it is possible to readily and firmly couple the connectors to each other by the screw engagement of the screw members after the units have been coupled to each other while protecting the housings of the connectors during coupling of the units.

In more detail, one screw member is a bolt provided on its distal end with a tapered surface while the other screw member is a nut having a screw hole provided with a tapered surface on the open edge. After coupling the units, the bolt is engaged with the nut, thereby fitting and securing the housings of the connectors. In addition, since the tapered surfaces are formed on the distal end of the bolt and on the open edge of the screw hole in the nut, it is possible to smoothly carry out the work of inserting the bolt into the screw hole.

Further, in the case where a guide portion is provided on the temporary supporting portion to guide the second connector from a temporary supporting position for the second connector to a position in which the tapered surface on the screw member on the second connector is trapped by the tapered surface on the screw member on the first connector, it is possible to surely guide the second connector from the former position to the latter position and to properly couple the connectors after the second connector is released from temporary support, even if a spaced distance between the connectors is set to be relatively great.

In the case where the guide portion is provided at a position in which it is still in contact with the second connector after the second connector is completely coupled to the first connector, a resilient guide portion made of rubber or the like will absorb a vibration between the first and second connectors and requires no clearance between the guide portion and the second connector, thereby surely guiding the connector.

In the case where a temporary engaging frame which is open toward the first connector and receives the second connector from the opening is provided in the second unit, where a resilient holding material is secured on the inside of the temporary engaging frame, and where the resilient holding material is provided with an engaging part which temporarily supports the second connector, it is possible to easily engage the second connector with the second unit temporarily by engagement of the engaging part and second connector. It is also possible to smoothly carry out a work of engaging the screw members with each other, in other words, to carry out a work of fitting the housings of the connectors to each other by displacing the second connector slightly by means of an elastic deformation of the resilient holding material even in the temporary position.

What is claimed is:

1. A connector assembly for a wire harness, comprising:

a first connector secured to a first unit;

a second connector to be connected to said first connector, said second connector being provided on a second unit to be coupled to said first unit;

a protector for said wire harness being provided on said second unit and including a protector body which encloses and protects said wire harness and a connector holder, formed together with said protector body and holding said second connector, movable toward said first connector in a connecting direction, said second connector being adapted to be connected to ends of electric wires in said wire harness;

a discrete holding member inside said connector holder resiliently biased against side walls of said second connector, said wire harness to be connected to said second connector being arranged in said protector body; said second connector being temporarily held in said connector holder by said holding member;

a securing position of said first connector on said first unit wherein said second connector is opposed to said first connector upon coupling said first and second units to each other.

2. A connector assembly for a wire harness according to claim 1, wherein said protector for a wire harness is separated from said second unit and said second unit receives said connector holder which supports said second connector and said protector body in which wire harnesses are arranged.

3. A connector assembly for a wire harness according to claim 1, wherein a first screw member is secured to one of said first and second connectors, a second screw member having a rotary operation head is attached to the other connector rotatably and not movably in an axial direction, said screw members are positioned so that the one screw member on said first connector is opposed to the other screw member on said second connector when said first and second units are coupled to each other, and said housings of said connectors are coupled to each other by screw engagement of said screw members while displacing said second connector with respect to said connector holder.

4. A connector assembly for a wire harness according to claim 2, wherein a first screw member is secured to one of said first and second connectors, a second screw member having a rotary operation head is attached to the other connector rotatably and not movably in an axial direction, said screw members are positioned so that the one screw member on said first connector is opposed to the other screw member on said second connector when said first and second units are coupled to each other, and said housings of said connectors are coupled to each other by screw engagement of said screw members while displacing said second connector with respect to said connector holder.

5. A connector assembly for a wire harness according to claim 1, wherein a connector-fastening tool is prepared to fasten said housings of said connectors upon coupling said units to each other, and said housing of said second connector is coupled to said housing of said first connector while displacing said second connector housing in relation to said connector holder by said fastening tool.

6. A connector assembly for a wire harness according to claim 2, wherein a connector-fastening tool is prepared to fasten said housings of said connectors upon coupling said units to each other, and said housing of said second connector is coupled to said housing of said first connector while displacing said second connector housing in relation to said connector holder by said fastening tool.

7. A connector assembly for a wire harness according to claim 1, wherein said first connector is fixed on said first unit, said second connector is provided on said second unit to be coupled to said first unit, one of said connectors has a female housing which is open to the other connector, the other connector has a male housing to be fitted in said female housing, said female housing is provided on the open end edge with a guide taper surface, said second unit is provided with a temporary latch means for detachably and temporarily supporting said second connector, a first screw member is fixed on one of said connectors, a second screw member is mounted on the other connector not slidably in an axial direction but rotatably in a peripheral direction, said second screw member being adapted to be engaged with said first screw member and having a rotary operation head, the fixing position of said first connector on said first unit and the temporary supporting position of said second connector on said second unit are set so that said housing and screw member of said second connector temporarily supported on said second unit are opposed to and spaced apart from said housing and screw member of said first connector fixed on said first unit when said first and second units are coupled to each other, and said screw members are engaged with each other so that said male housing enters said female housing when said second connector is released from being temporarily supported on said second unit.

8. A connector assembly for a wire harness according to claim 7, wherein one of said screw members is a bolt provided on the distal end with a tapered surface and the other screw member is a nut having a screw hole provided with a tapered surface on the open edge.

9. A connector assembly for a wire harness according to claim 8, wherein a guide portion is provided on the temporary supporting portion to guide said second connector from the temporary supporting position for said second connector to a position in which the tapered surface on said screw member on said second connector is trapped by the tapered surface on said screw member on said first connector.

10. A connector assembly for a wire harness according to claim 9, wherein said guide portion is provided on said temporary supporting portion so as to come into contact with said second connector even after said second connector is completely coupled to said first connector and said guide portion is made of a resilient material.

11. A connector assembly for a wire harness according to claim 9 wherein a temporary engaging frame which is open toward said first connector and receives said second connector from the opening is provided in the second unit, a resilient holding material is secured on the inside of the temporary engaging frame, and said resilient holding material is provided with an engaging part which temporarily supports said second connector.

12. A connector assembly for a wire harness according to claim 10 wherein a temporary engaging frame which is open toward said first connector and receives said second connector from the opening is provided in the second unit, a resilient holding material is secured on the inside of the temporary engaging frame, and said resilient holding material is provided with an engaging part which temporarily supports said second connector.

13. A connector assembly for a wire harness according to claim 8, wherein a temporary engaging frame which is open toward said first connector and receives said second connector from the opening is provided in the second unit, a resilient holding material is secured on the inside of the temporary engaging frame, and said resilient holding material is provided with an engaging part which temporarily supports said second connector.

* * * * *